US005106033A

United States Patent [19]

Phan

[11] Patent Number: 5,106,033

[45] Date of Patent: Apr. 21, 1992

[54] MISSILE GUIDANCE ELECTRONICS ASSEMBLY FOR PORTABLE GUIDED MISSILE LAUNCHER

[75] Inventor: Dzung V. Phan, Moorpark, Calif.

[73] Assignee: Hughes Aircraft Company, Los Angeles, Calif.

[21] Appl. No.: 673,619

[22] Filed: Mar. 22, 1991

[51] Int. Cl.[5] ..... F41G 7/32

[52] U.S. Cl. ..... 244/3.12

[58] Field of Search ..... 244/3.12; 89/1.816, 89/1.817, 1.818, 1.819

[56] References Cited

U.S. PATENT DOCUMENTS

| | | | |
|---|---|---|---|
| 3,233,847 | 2/1966 | Girsberger | 244/3.12 |
| 3,389,637 | 6/1968 | Beier et al. | 89/1.816 |
| 4,247,059 | 1/1981 | Duke et al. | 244/3.12 |
| 4,406,429 | 9/1983 | Allen | 244/3.11 |
| 4,611,771 | 9/1986 | Gibbons et al. | 244/3.12 |
| 4,666,103 | 5/1987 | Allen | 244/3.11 |
| 4,705,237 | 11/1987 | Goldfeld et al. | 244/3.12 |

*Primary Examiner*—Charles T. Jordan

*Attorney, Agent, or Firm*—R. M. Heald; C. D. Brown; W. K. Denson-Low

[57] ABSTRACT

A tube-launched, optically-tracked, wire guided (TOW) portable guided missile system (10) includes a launch tube (16) mounted on a tripod (18) or vehicle, and an optical/thermal sighting and tracking assembly (22) mounted on and aligned with the launch tube (16). The system operator (20) mechanically trains the assembly (22) to maintain a target (38) visually centered in a reticle, thereby establishing a line-of-sight (40) to the target (38). The assembly (22) tracks the target (38) optically or thermally, and feeds guidance signals to the missile (14) through a wire (46) to maintain the missile flight path coincident with the line-of-sight (40). An improved missile guidance electronics unit (44) is environmentally sealed in a small housing (60) which removably fits into a compartment (52) in the sighting and tracking assembly (22), thereby enabling the optical/thermal sighting and tracking elements (26,28) and guidance electronics (88) to be integrated into a compact, unitary assembly (22).

9 Claims, 4 Drawing Sheets

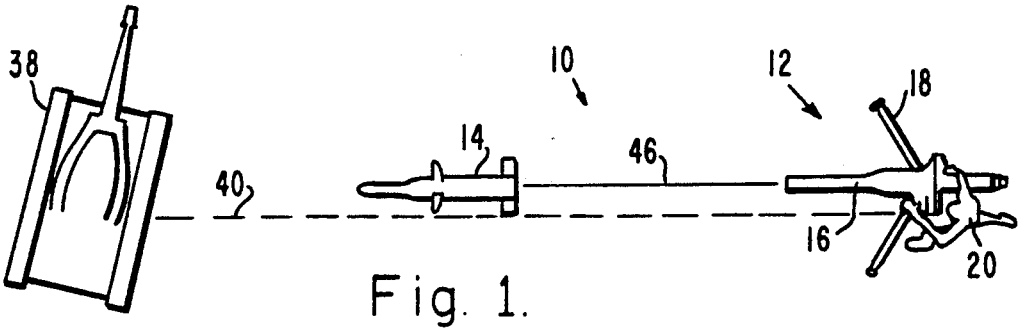
Fig. 1.
Fig. 2.
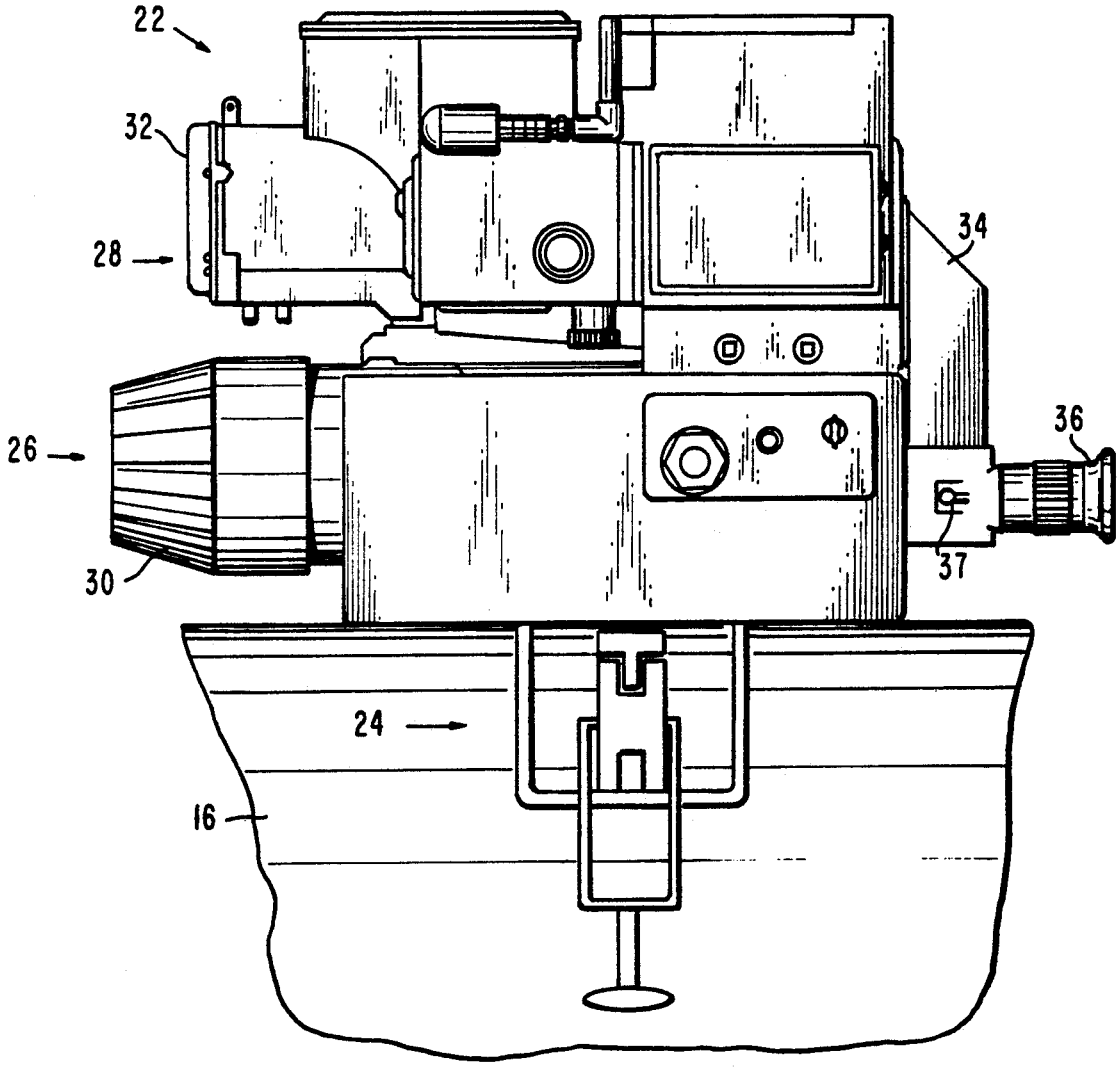

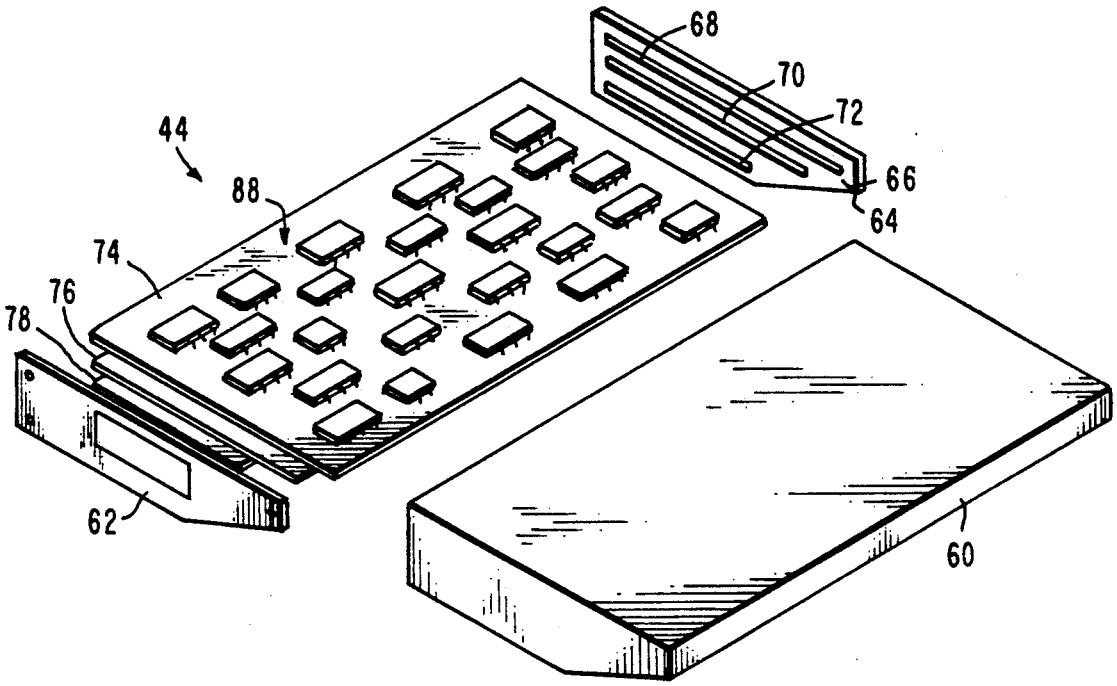
Fig. 4
Fig. 5
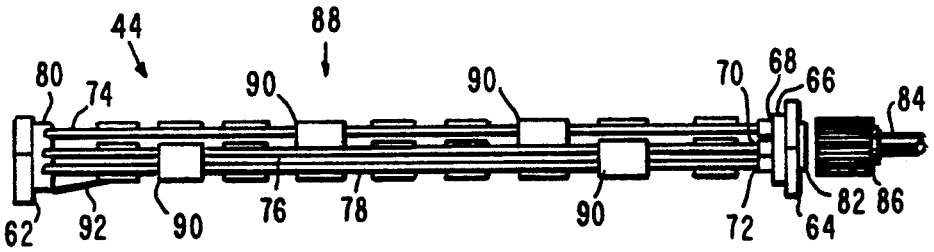

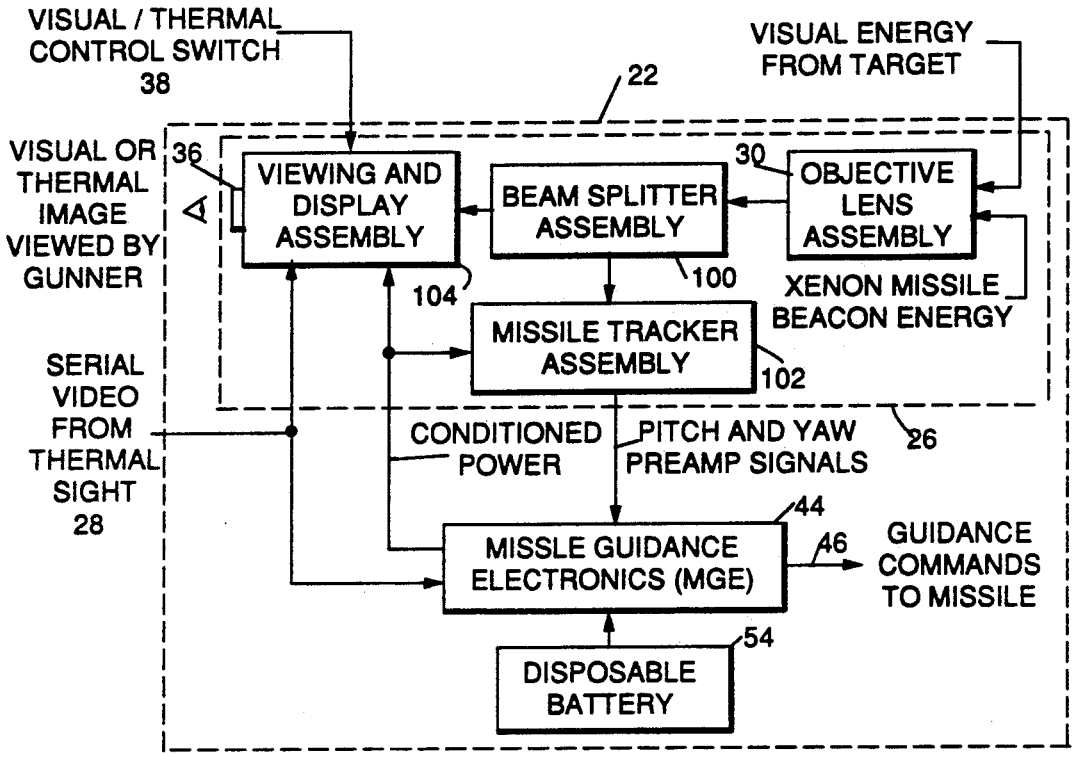
FIG. 6.
FIG. 7.
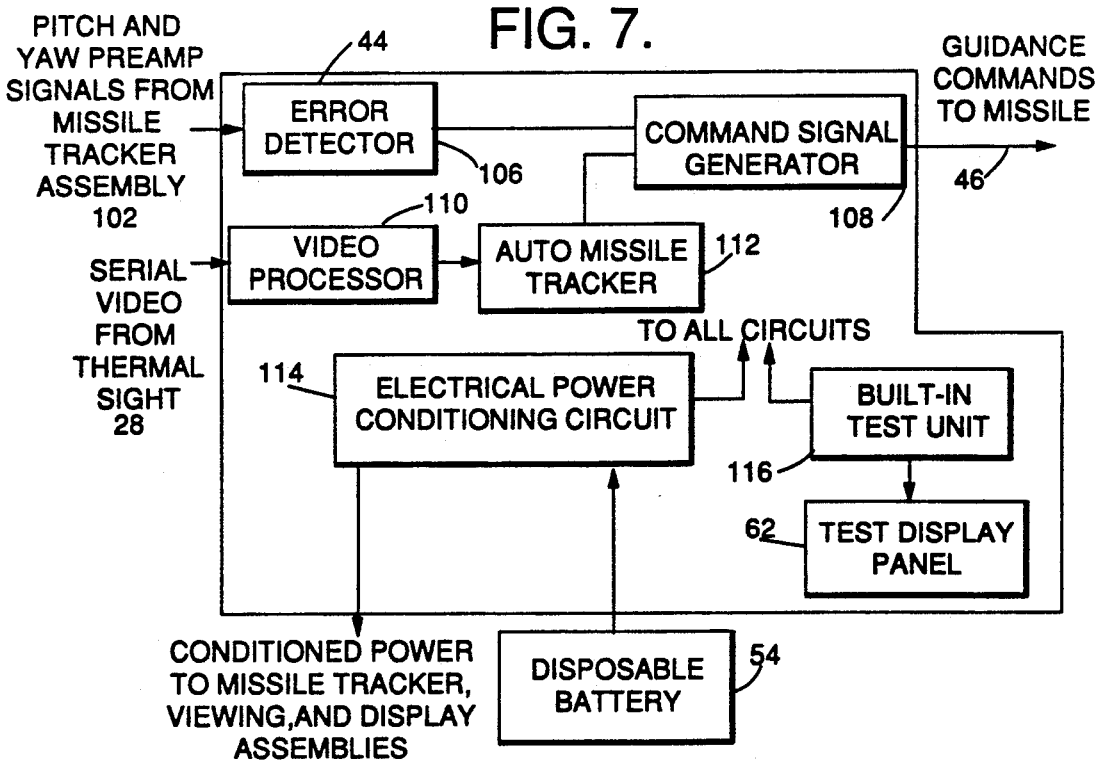

MISSILE GUIDANCE ELECTRONICS ASSEMBLY FOR PORTABLE GUIDED MISSILE LAUNCHER

BACKGROUND OF THE INVENTION

1. Field of the Invention

The present invention relates to a tube-launched, optically-tracked, wire-guided (TOW) portable guided missile system including optical/thermal sighting and tracking elements and missile guidance electronics integrated into a unitary assembly.

2. Description of the Related Art

TOW is a heavy antitank assault missile weapon system consisting of a guided missile and portable launcher which is designed to function effectively against tanks, fortifications, etc. The launcher includes a tripod or vehicle mount, which supports a launch tube and mechanical traversing unit, and a sighting and tracking assembly which is attached to and aligned with the launch tube.

To engage a target, the system operator or gunner acquires the target visually through an optical or thermal night sight of the sighting and tracking assembly, and mechanically trains the launch tube in azimuth and elevation using the traversing unit to maintain the target centered in a reticle. Upon achieving target alignment, the operator fires the missile by manually depressing an electrical trigger switch.

As the missile is launched, a wire which forms the communications link between the launcher and missile is dispensed from the missile. Deviations of the missile from the intended line-of-sight trajectory are sensed by optical or thermal detectors in the sighting and tracking assembly which tracks the missile optically or thermally, and feeds guidance signals to the missile through the wire to maintain the missile flight path coincident with the line-of-sight.

The missile performs corrective maneuvers by means of aerodynamic control surfaces which deflect in response to the guidance signals from the launcher transmitted over the wire. Upon target impact, a high-explosive, shaped-charge warhead is detonated.

A conventional TOW missile system is disclosed in U.S. Pat. Nos. 4,406,429, entitled "MISSILE DETECTING AND TRACKING UNIT", issued Sept. 27, 1983; and 4,666,103, entitled "CARRIER TRACKING SYSTEM", issued May 19, 1987, both to J. Allen. The sighting and tracking assembly includes an optical and/or thermal sighting and tracking unit which is mounted on the launch tube, and a separate missile guidance set (MGS) packaged in a stand-alone housing.

The MGS is transported separately from the launcher, placed on the ground or in a vehicle rack for operation, and connected to the launcher by a relatively long cable. The housing encloses the missile guidance electronics per se, as well as a rechargeable nickel-cadmium battery for powering the system. The conventional arrangement is disadvantageous in that it includes two separate large and heavy units, and suffers from transportability and deployment drawbacks. In addition, the cable which connects the MGS to the launcher is exposed, and vulnerable to damage which would render the missile system inoperative under adverse conditions.

SUMMARY OF THE INVENTION

In accordance with the present invention, a TOW portable guided missile system includes a launch tube mounted on a tripod or vehicle, and an optical/thermal sighting and tracking assembly mounted on and aligned with the launch tube. An improved missile guidance electronics (MGE) unit is environmentally sealed in a small housing which removably fits into a compartment in the sighting and tracking assembly, thereby enabling the optical/thermal sighting and tracking elements and guidance electronics to be integrated into a compact, unitary assembly.

The improved MGE unit is much smaller and lighter than the conventional MGS, thereby enabling integration of the MGE unit into the sighting and tracking assembly. This greatly increases the portability of the missile system, and eliminates the exposed cable which connects the conventional MGS to the launcher. The present arrangement also reduces the production cost of the missile system, while increasing the reliability thereof.

These and other features and advantages of the present invention will be apparent to those skilled in the art from the following detailed description, taken together with the accompanying drawings, in which like reference numerals refer to like parts.

DESCRIPTION OF THE DRAWINGS

FIG. 1 is a diagram illustrating the overall configuration of the present guided missile launcher;

FIG. 2 is a side elevation illustrating a sighting and tracking assembly of the present launcher mounted on a launch tube thereof;

FIG. 4 is an exploded perspective view of the MGE;

FIG. 5 is a side elevation of the MGE with a cover thereof removed;

FIG. 6 is a block diagram of the sighting and tracking assembly; and

FIG. 7 is a block diagram of the MGE.

DETAILED DESCRIPTION OF THE INVENTION

Figure 3:
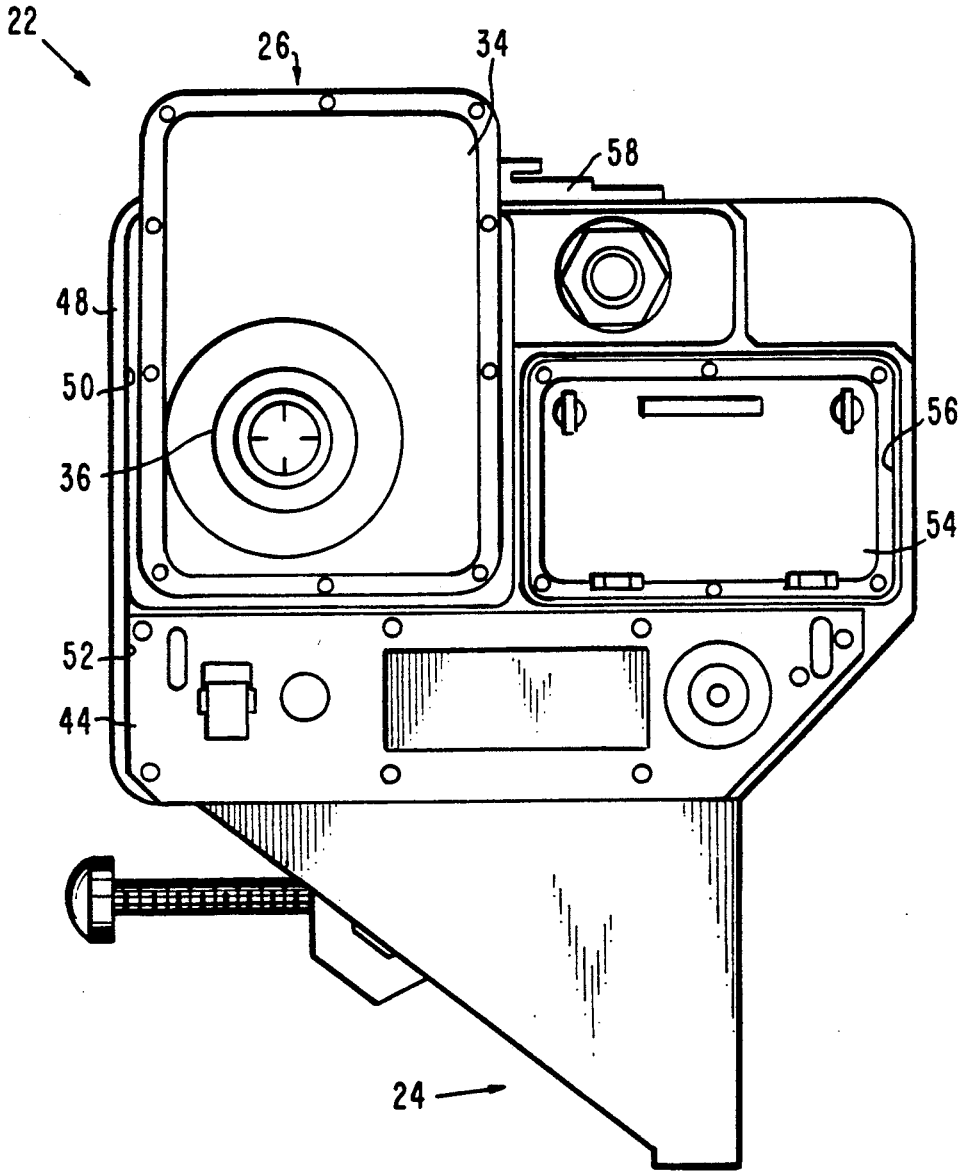
FIG. 3 is a front elevation illustrating part of the sighting and tracking assembly including an improved missile guidance electronics (MGE) unit embodying the present invention incorporated therein.

Referring now to FIG. 1 of the drawings, a portable guided missile system embodying the present invention is generally designated as 10, and includes a launcher assembly 12. A missile 14 is retained in a launch tube 16 of the assembly 12 prior to deployment. The launch tube 16 is mounted on a tripod 18, which is provided with a mechanical traversing unit (not shown) by which the system operator or gunner 20 can train the tube 16 in azimuth and elevation.

As viewed in FIG. 2, a sighting and tracking assembly 22 is attached to the launch tube 16 in alignment therewith by a clamp 24. The assembly 22 includes an optical sight sensor 26, and a thermal night sight 28 mounted on the sensor 26. The sensor 26 has an objective lens assembly 30 for receiving visual energy from a target, whereas the night sight 28 has an objective 32 for receiving thermal energy from the target. The sensor 26 and sight 28 are coupled together by an optical selector unit 34 such that the gunner 20 can view a visual image from one or the other through a common eyepiece assembly 36. A day/night switch 37 is provided on the selector unit 34 for selection of day (optical sensor 26) or night (thermal night sight 28) operation.

To operate the system, the gunner 20 acquires a target such as a tank 38 through the eyepiece assembly 36, and mechanically trains the launcher tube 16 until the tank 38 is centered in a reticle (not shown) of the assembly 22. The launcher tube 16 may continue to be trained at any time prior to impact of the missile 14 to maintain target alignment in response to movement of the tank 38. This operation establishes a line-of-sight 40 between the launcher tube 16 and sighting and tracking assembly 22 and the tank 38 which is the desired trajectory for the missile 14. When proper target alignment has been achieved, the gunner 20 presses a launch button (not shown) on the traversing unit to launch the missile 14.

The optical sight sensor 26 includes an infrared tracking unit (not shown) for tracking an optical signal radiated by a xenon beacon (not shown) carried by the missile 14. The night sight 28 includes a thermal tracking unit (not shown) for tracking a thermal signal radiated by a thermal beacon (not shown) carried by the missile 14, or alternatively the missile launch motor residual heat or flight motor plumes. The optical sight sensor 26 is generally more accurate and is the preferred sighting means. However, the night sight 28 enables operation under conditions of poor visibility, or where hostile countermeasures are in effect for jamming of the infrared beacon signal.

In accordance with the present invention, the assembly 22 further includes a missile guidance electronics (MGE) unit 44 as illustrated in FIG. 3. The tracking signals from the optical sight sensor 26 or thermal night sight 28 designate the instantaneous position of the missile 14 relative to the line-of-sight 40. The MGE unit 44 computes error signals corresponding to the deviation between the sensed missile position and the line-of-sight 40 and transmits electrical guidance signals to the missile 14 through a wire 46 (illustrated in FIG. to urge the missile 14 toward the line-of-sight 40. Any deviation of the missile trajectory from the line-of-sight 40 causes the MGE unit 44 to generate a guidance signal in the opposite direction to urge the missile 14 back on the desired trajectory.

The sighting and tracking assembly 22 includes a mount 48 which is attached to the launcher tube 16 by the clamp 24. The mount 48 has a compartment 50 for receiving the optical sight sensor 26, and another compartment 52 underneath the compartment 50 for receiving the MGE unit 44. A disposable battery 54 for powering the assembly 22 is received in another compartment 56 of the mount 48. The sensor 26, MGE unit 44, and battery 54 are securely but removably retained in the respective compartments 50, 52 and 56 by screws or other fastening means (not designated). Further illustrated in FIG. 3 is a bracket 58 for attaching the night sight 28 to the mount 48.

As viewed in FIGS. 4 and 5, the MGE unit 44 includes a housing 60 which is environmentally sealed at its opposite ends by panels 62 and 64. A motherboard 66 is attached to the inner surface of the panel 64, and has edge connectors 68, 70 and 72 mounted thereon which connect to respective edges of printed wiring boards 74, 76 and 78. A retainer strip 80 is fixed to the inner surface of the panel 62, and formed with slots (not designated) which fixedly retain the opposite ends of the wiring boards 74, 76 and 78. The edge connectors 68, 70 and 72 are connected to jacks 82 (only one of which is visible in FIG. 5) which extend external of the panel 64 for connection of the MGE unit 44 to the optical sight sensor 26, night sight 28, and wire 46. A representative cable 84 is shown, having a plug 86 which connects to the jack 82.

A plurality of electronic components which constitute the actual guidance electronics of the MGE unit 44 are mounted on the printed wiring boards 74, 76, and 78 and collectively designated as 88. One of the wiring boards may be dedicated to power conditioning circuitry. The boards 74, 76 and 78 may be interconnected with each other at desired points by connecting cables 90. The panel 62 faces external of the compartment 52 toward the gunner 20, and is provided with various switches and display indicators for performing operational checks of the assembly 22. A cable 92 is illustrated in FIG. 5 for connecting the board 78 to these switches and indicators.

Although not shown in detail, the printed wiring boards 74, 76 and 78 are preferably on the order of ten layers thick with a copper heatsink layer on the component sides of the boards. The heatsink layer aids in transferring heat dissipated by the various components 88 to the walls of the housing 60. Locking devices (not shown) are provided to clamp the edges of the boards 74, 76 and 78 firmly into the slots of the edge connectors 68, 70 and 72 and retainer strip 80. Metal stiffeners (not shown) are bonded and riveted to the boards 74, 76 and 78 to resist damage resulting from flexure caused by shock and vibration. The size of the MGE unit 44 may be reduced to the required dimensions by the integration of applicable components, and replacement of other components with microprocessor controlled firmware. The preferred dimensions for the MGE unit 44 are approximately 26.7 cm long, 25.7 cm wide, and 6.9 cm deep.

A block diagram of the sighting and tracking assembly 22 excluding the night sight 28 is illustrated in FIG. 6. A visual image of the target as well as infrared energy from the xenon beacon on the missile 14 are collected by the objective lens assembly 30. A beam splitter assembly 100 directs the infrared energy to a missile tracker assembly 102, and the visual energy to a viewing and display assembly 104 which provides a visual image to the gunner at the eyepiece assembly 36. A thermally generated visual image is also fed to the assembly 104 from the night sight 28 via the optical selector unit 34 so that the gunner can select either the optical image from the optical sight sensor 26 or the thermally generated image from the night sight 28 depending on the prevailing conditions.

The missile tracker assembly 102 operates on the infrared signals from the beam splitter assembly 100 and azimuth and elevation signals from the traversing unit of the launcher 12, and feeds pitch and yaw preamplifier signals designating the position of the missile 14 relative to the line-of-sight 40 to the MGE unit 44. The thermal image from the night sight 28 is also applied to the MGE unit 44, which computes the deviation of the missile from the line-of-sight 40 and feeds the guidance signals through the wire 46 to urge the missile 14 toward the line-of-sight 40. The MGE unit 44 further provides conditioned power for the viewing and display assembly 104 and missile tracker assembly 102.

A block diagram of the MGE unit 44 is illustrated in FIG. 7. The unit 44 includes an error detector 106 which receives signals designating the missile position relative to the line-of-sight 40 from the tracker assembly 102, and converts them into error signals corresponding to the deviation therefrom. The error signals are fed to a command signal generator 108 which generates the guidance signals that are transmitted to the missile through the wire 46.

Serial video from the thermal sight 28 is applied to a video processor 110, which produces signals representing a thermal video image corresponding to the visual image viewed by the gunner. The video processor 110 generates signals designating the missile position relative to the line-of-sight 40, and feeds them to an automatic missile tracker 112 which generates error signals corresponding to those generated by the error detector 106. The command signal generator 108 preferably comprises circuitry (not shown) which determines which set (visual or thermal) of error signals is of higher quality based on a programmed algorithm, and selects the better set for generation of the missile guidance signals.

Further illustrated in FIG. 7 are an electrical power conditioning circuit 114, and a built-in test unit 116 for generating signals suitable for performing the test procedures displayed on the panel 62.

While several illustrative embodiments of the invention have been shown and described, numerous variations and alternate embodiments will occur to those skilled in the art, without departing from the spirit and scope of the invention. Accordingly, it is intended that the present invention not be limited solely to the specifically described illustrative embodiments. Various modifications are contemplated and can be made without departing from the spirit and scope of the invention as defined by the appended claims.

I claim:

1. A portable guided missile launcher including missile launch tube means, sighting and tracking means for establishing a line-of-sight from the launch tube means to a target and tracking a missile launched from the launch tube means toward the target, guidance electronics means responsive to the sighting and tracking means, a wire connecting the guidance electronics means to the missile, the guidance electronics means computing a deviation between a missile position sensed by the sighting and tracking means and said line-of-sight and transmitting guidance signals to the missile through the wire to urge the missile toward said line-of-sight, and mounting means for integrally mounting the sighting and tracking means on the launch tube means, characterized by:

the guidance electronics means comprising:

a housing including a motherboard supported therein;

guidance electronic component means mounted in the housing and comprising a plurality of printed wiring boards disposed inside the housing and connected to the motherboard, with a plurality of electronic components mounted on the wiring boards;

electrical connector means within said housing means for interconnecting the guidance electronic component means with the sighting and tracking means and the wire; and the mounting means being formed with a compartment for receiving the housing.

2. A launcher as in claim 1, in which the connector means comprises:

a plurality of edge connectors mounted on the motherboard for connection with edges of the wiring boards respectively;

external connector means connecting the edge connectors with the sighting and tracking means and the wire.

3. A launcher as in claim 2, in which the connector means further comprises internal connector means interconnecting the wiring boards with each other.

4. A launcher as in claim 2, in which the housing is environmentally sealed.

5. A launcher as in claim 1, in which:

the sighting and tracking means includes optical sighting and tracking means and thermal sighting and tracking means; and the guidance electronics means comprises means responsive to the optical sighting and tracking means and the thermal sighting and tracking means for computing said deviation between said missile position sensed by a selected one of the optical sighting and tracking means and thermal sighting and tracking means and said line-of-sight, and transmitting said guidance signals to the missile through the wire to urge the missile toward said line-of-sight.

6. A launcher as in claim 1, in which the housing comprises a display and test panel facing external of said compartment and being interconnected with the guidance electronic component means.

7. A launcher as in claim 1, in which said compartment is disposed underneath the sighting and tracking means.

8. A launcher as in claim 7, further comprising clamping means extending from the mounting means underneath said compartment for removably attaching the mounting means to the launch tube means.

9. A portable guided missile launcher including missile launch tube means, sighting and tracking means for establishing a line-of-sight from the launch tube means to a target and tracking a missile launched from the launch tube means towards the target, guidance electronics means responsive to the sighting and tracking means, a wire connecting the guidance electronics means to the missile, the guidance electronics means computing a deviation between a missile position sensed by the sighting and tracking means and said line-of-sight and transmitting guidance signals to the missile through the wire to urge the missile toward said line-of-sight, and mounting means for integrally mounting the sighting and tracking means on the launch tube means, characterized by:

the guidance electronics means comprising:

a housing;

guidance electronic component means mounted in the housing; and electrical connector means within said mounting means for interconnecting the guidance electronic component means with the sighting and tracking means and the wire; and the mounting means being formed with a compartment for receiving the housing.

* * * * *

UNITED STATES PATENT AND TRADEMARK OFFICE

CERTIFICATE OF CORRECTION

PATENT NO. : 5,106,033

DATED : April 21, 1992

INVENTOR(S) : Dzung V. Phan

It is certified that error appears in the above-identified patent and that said Letters Patent is hereby corrected as shown below:

Column 5, line 58, delete the word "housing" an dinsert --mounting--.

Column 6, line 62, after the word "housing" insert --wherein the housing is removably received in said compartment--.

Signed and Sealed this

Sixth Day of July, 1993

*Attest:*

Michael K. Kirk

MICHAEL K. KIRK

*Attesting Officer*

*Acting Commissioner of Patents and Trademarks*